United States Patent [19]

Linder et al.

[11] 3,942,493

[45] Mar. 9, 1976

[54] FUEL METERING SYSTEM

[75] Inventors: Ernst Linder, Muhlacker; Gregor Schuster, Stuttgart, both of Germany

[73] Assignee: Robert Bosch GmbH, Stuttgart, Germany

[22] Filed: Sept. 24, 1973

[21] Appl. No.: 399,914

[30] Foreign Application Priority Data

Sept. 22, 1972 Germany ..... 2246625

[52] U.S. Cl...... 123/119 D; 261/41 D; 261/DIG. 74

[51] Int. Cl.[2]..... F02B 33/00; F02M 7/00

[58] Field of Search..... 123/32 EA, 32 AE, 119 D; 60/276; 261/DIG. 74, 41 D, 121 B

[56] References Cited

UNITED STATES PATENTS

| | | | |
|---|---|---|---|
| 2,208,317 | 7/1940 | Beck | 261/121 B |
| 3,493,217 | 2/1970 | Farley | 261/121 B |
| 3,590,793 | 7/1971 | Masaki | 123/119 D |
| 3,608,874 | 9/1971 | Beckmann | 261/41 D |
| 3,675,632 | 7/1972 | Nakajima | 123/119 D |
| 3,738,341 | 6/1973 | Loos | 60/276 |
| 3,745,768 | 7/1973 | Zechnall et al. | 123/32 EA |
| 3,759,232 | 9/1973 | Wahl et al. | 123/32 EA |
| 3,761,063 | 9/1973 | Shibanana et al. | 261/41 D |
| 3,768,259 | 10/1973 | Carnathan et al. | 60/276 |
| 3,813,877 | 6/1974 | Hunt | 261/41 D |
| 3,828,749 | 8/1974 | Knapp | 123/139 E |
| 3,841,283 | 10/1974 | Wood | 261/DIG. 74 |
| 3,866,583 | 2/1975 | Pundt | 123/139 AE |

FOREIGN PATENTS OR APPLICATIONS

| | | | |
|---|---|---|---|
| 1,253,667 | 11/1971 | United Kingdom | |
| 600,895 | 4/1948 | United Kingdom | 123/32 EA |

*Primary Examiner*—Wendell E. Burns
*Assistant Examiner*—Paul Devinsky
*Attorney, Agent, or Firm*—Edwin E. Greigg

[57] ABSTRACT

What follows is a description of a fuel metering system for internal combustion engines having a measuring probe. The probe monitors the composition of the exhaust gas and produces an output signal which is used to govern the motions of a magnetic valve which in turn regulates the amount of air mixed in with fuel prior to the admission of this mixture to the veturi in the suction tube of the carburator.

13 Claims, 3 Drawing Figures

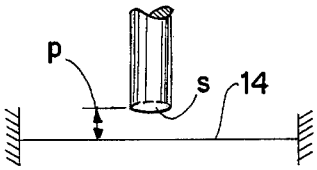
Fig. 1a
Fig. 1
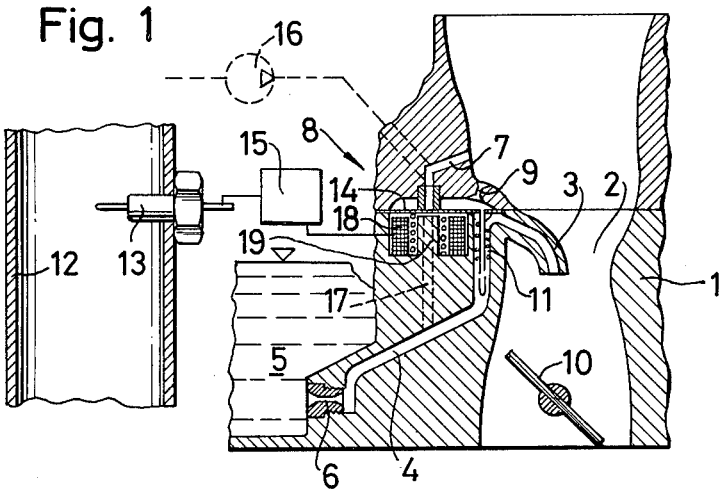
Fig. 2
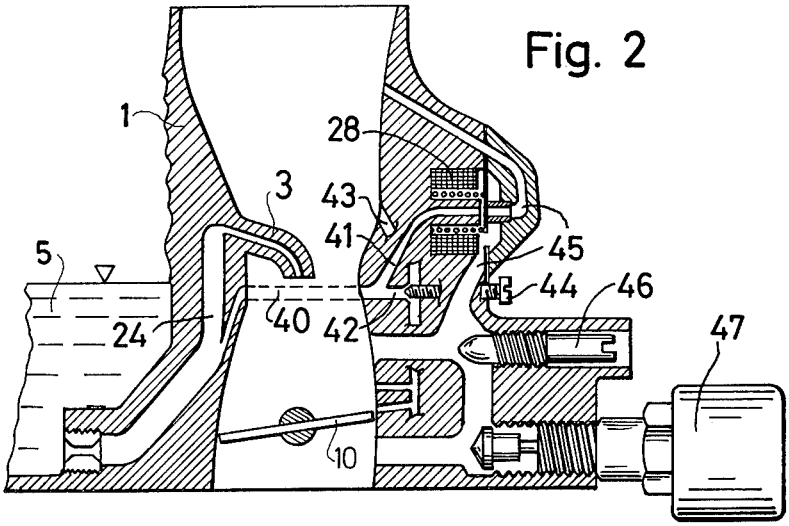

FUEL METERING SYSTEM

BACKGROUND OF THE INVENTION

The invention relates to a fuel metering system for internal combustion engines, comprising a fuel reservoir and a fuel line leading from the fuel reservoir to a suction tube. The fuel line has within it a location with controllable cross section. The metering system further comprises an air line, also controllable in cross section. The fuel quantity metered out to the air quantity streaming through the suction tube is adjustable in dependence on the pressures prevailing in the fuel reservoir and in the suction tube as well as on the output signal of a measuring probe which determines the composition of the exhaust gas.

The purpose of such a fuel metering system is to automatically provide a favorable fuel-air mixture ratio for an Otto engine under all operational conditions in order to burn the fuel as completely as possible and therefore to avoid or to reduce sharply the generation of toxic exhaust gases while maintaining the highest possible performance and the lowest possible fuel consumption of the internal combustion engine.

For this purpose it is required that during the start-up of a cold engine and during the warm-up phase of that engine, the fuel air mixture be richer than is required for a warm engine, i.e. the fuel portion must be greater. But even with a warm engine, the fuel quantity must be metered very precisely depending on the requirements of each operational condition of the internal combustion engine. In particular, the proportionality between air quantity and fuel quantity must be changeable in dependence on the engine parameters.

In known fuel metering systems of this kind, the output signals of the measuring probe which exhibit voltage fluctuations are integrated in electronic circuitry and serve as an integrated voltage in the generation of the control value for changing the pressure in the suction tube or in the fuel reservoir.

OBJECTS AND SUMMARY OF THE INVENTION

It is an object of this invention to develop a fuel metering system of the kind described above in which intervention in the pressure relations is possible with the simplest of means and where this system can be retrofitted in fuel metering systems already in operation.

This and other objects are achieved, according to the invention, in that the fuel line and the air line communicate prior to entry into the suction tube and in that the air line is controlled by a magnetic valve actuated by the measuring probe. In simple carburators, the controlled air line is the compensation air line which terminates in the fuel line prior to entry into the suction tube. In bypass air type carburators, in which the fuel line may consist of a main line and a secondary fuel line of smaller cross section, the air line terminating in the secondary fuel line is the one controlled by the magnetic valve.

According to an advantageous development of the invention, and in addition to the control of the air line, the secondary fuel line or the main fuel line is also controllable in dependence on the output signal of the measuring probe but with a constantly open residual cross section in the case of the main fuel line. When both an air line and a fuel line are controlled the control is such that the cross sections defined by the air and fuel lines and the valve are changeable in a reverse sense. According to the invention, the movable valve member can be a membrane which preferably serves also as an armature and is disposed between two valve seats, in this way it separates the fuel chamber from the air chamber.

Two exemplary embodiments of the object of the invention are shown in the drawing and are further described below.

BRIEF DESCRIPTION OF THE DRAWING

FIG. 1 schematically illustrates in cross section a simple carburator with a venturi and a compensation air channel according to the invention.

FIG. 1*a* is a partial schematic view of only that portion of the magnetic valve including the diaphragm and valve seat.

FIG. 2 schematically illustrates in cross section a bypass air type carburator according to the invention.

DESCRIPTION OF THE PREFERRED EMBODIMENTS

Reference in the specification will be made to the air number, denoted lambda ($\lambda$). This air number $\lambda$ is a measure of the composition of the fuel-air mixture, The number $\lambda$ is proportional to the mass of air and fuel, and the value of this number $\lambda$ is one ($\lambda = 1.0$) if a stoichiometric mixture is present. Under stoichiometric conditions, the mixture has such a composition that, in view of the chemical reactions, all hydrocarbons in the fuel can theoretically combine with the oxygen in the air to provide complete combustion to carbon dioxide and water. In actual practice, even with a stocihiometric mixture, unburned non-combusted hydrocarbons and carbon monoxide are contained in the exhaust gases.

Turning now more specifically to the drawings, there is shown a carburator housing 1 within which is located a venturi 2 into which terminates a fuel line branch 3. The branch 3 is connected through a fuel line 4 with a fuel reservoir 5. Within the fuel line 4, a main nozzle 6 of constant cross section is disposed. One end of a compensation air line 7, controlled by a magnetic valve 8, terminates in the fuel line 4. The other end of the air line 7 terminates in the suction tube at a location upstream of the venturi 2. The section of the compensation air line 7 which lies between magnetic valve 8 and fuel line 4 also communicates with the suction tube through a nozzle 9. Whenever the flow cross section in the suction tube is altered by an arbitrarily adjustable throttle flap 10, the reduced pressure within the venturi 2 is transmitted through the fuel line branch 3, the fuel line 4 and the fuel nozzle 6 into the float chamber (fuel reservoir) 5. In this process, air streams through the compensation air line 7 into the fuel line 4 and is mixed with fuel in a mixture region 11 of fuel line 4 where an emulsion is formed which is aspirated through fuel line branch 3. Depending on the throttle cross sections and the different properties of the liquids, the air component of the mixture increases with increasing rpm and, hence, the mixture becomes leaner. The cross section of nozzle 9 is chosen in such a way that, even at high rpm, only a small quantity of air enters through it. The main compensation air quantity, however, is controlled by the magnetic valve 8. As soon as this valve opens, the fuel-air mixture becomes leaner and whenever the valve closes, it becomes richer.

The magnetic valve 8 is controlled by a measuring probe 13 disposed in the exhaust pipe 12. This measuring probe 13 is a small tube, closed at one end, and consisting of a solid electrolyte, for example, zirconium dioxide, obtained by sintering. On both sides, the small tube is covered with microporous layers of platinum, which are provided with contacts, not shown, and which exhibit an electric potential with respect to one another. One side of the tube is in contact with the ambient air, and the other side is in contact with the exhaust gas of the vehicle. During higher temperatures, such as prevail in the exhaust gas stream, the solid electrolyte conducts oxygen ions. When the partial oxygen pressure of the exhausst gas is different from the partial oxygen pressure of the ambient air, a potential difference is generated between the two platinum layers and between the two connecting clamps, which are not shown, and the time behavior of this potential difference is dependent on the air number $\lambda$. This potential difference is a logarithmic function of the quotient of the partial oxygen pressures on the two sides of the solid electrolyte. For this reason, the output voltage of the oxygen measuring probe 13 changes abruptly in the vicinity of the air number $\lambda = 1.0$. When $\lambda$ is greater than 1.0, unburned oxygen occurs abruptly in the exhaust gas. Because of the strong dependence of the output voltage of the measuring probe on the air number $\lambda$, this oxygen probe is extremely well suited for being used in the control of a magnetic valve. The output voltage of the oxygen probe is high in the region $\lambda < 1$ and low in the region $\lambda > 1$. For this reason, the magnetic valve 8 opens the compensation air line 7 whenever the measuring probe puts out a high voltage, i.e., whenever the fuel air mixture has become too rich. An oxygen probe can provide approximately 5 current pulses per second during each of which the magnetic valve 8 intermittently opens the air compensation line. This cycling of the magnetic valve 8 continues until an air number $\lambda$ proportional to unity is achieved. This value has been found to be particularly advantageous and corresponds to a stoichiometric mixture In order to improve the engine running in idle or at full load it is favorable to deviate somewhat from unity by enriching the mixture.

The movable valve member of magnetic valve 8, developed as a membrane 14, can also be actuated in such a way that its stroke and therefore the opening cross section or flow passage *p* (measured between the membrane 14 and the valve seat *s*, FIG. 1*a*) of the air compensation line 7, corresponds to the strength of the applied current. The use of a membrane as the valve armature is known in the art. See, for example, U.S. Pat. No. 3,765,387. In that case, the pulses of the measuring probe are fed to an electronic proportional controller 15 and are converted into a current valve corresponding to the oxygen content of the exhaust gas. The controller 15 is of a known construction, for example, the controller disclosed in U.S. Pat. No. 3,828,749.

As is shown in broken lines in FIG. 1, the compensation air can also be influenced by a blower 16. It is also possible to provide fuel through a fuel line 17 and through magnetic valve 8 and to control it by the side of the membrane 14 facing the magnetic coil 18. In that case, a tubular stud 19 acting as a fuel line is surrounded by a spring and the coil 18, and this space directly communicates with the mixture chamber 11. Two flow passages *p*, one on each side of the membrane 14, are controlled, as is the flow passage p shown in FIG. 1*a*, by movement of the membrane.

In the bypass air chamber shown in FIG. 2, a secondary fuel line 40 branches off from a main line 24; the secondary fuel line 40 branches off into lines 41 and 42. Line 42 carries the idling fuel whose quantity is adjustable by a screw 44. In addition, an air line 43 terminates in the fuel line 42 in order to obtain a favorable emulsion of air and fuel for the idling operation of the engine.

Fuel line 41, on the other hand, which terminates in a bypass air line 45, is controlled by a magnetic valve 28 operating in the same way as the magnetic valve 18 described in FIG. 1. The bypass air mixture can additionally be adjusted by a regulating screw 46 and can be shut off by a magnetic valve 47. Such a magnetic valve is disclosed in British Pat. No. 1,253,667.

The discharge voltage of a probe is between 80 and 500 millivolts.

What is claimed is:

1. In a fuel metering system for internal combustion engines of the type which includes an exhaust system, a suction tube, a fuel reservoir, a flow controlled fuel line leading from the fuel reservoir to the suction tube, a flow controlled air line and a measuring probe disposed in the exhaust system, with the fuel quantity metered out to the air stream in the suction tube depending on the pressures prevailing in the fuel reservoir and in the suction tube, and further on the output signal of the measuring probe, the improvement comprising: a magnetic valve to control the flow in said air line, said magnetic valve including a movable valve member in the form of a membrane which serves as the armature of said magnetic valve; means defining a space in which said magnetic valve is situated and in which the fuel line and the air line terminate; and means connected between said magnetic valve and said measuring probe so that said magnetic valve can be actuated by the output signal from said measuring probe, with said fuel line and said air line being disposed to communicate prior to entry into said suction tube, wherein the air and fuel lines include opposing ends defining valve seats between which said membrane separates and defines with said space defining means a fuel space from an air space.

2. A fuel metering system as defined in claim 1, wherein said air line terminates in said fuel line prior to the latter's entry into said suction tube.

3. A fuel metering system as defined in claim 1, further comprising a secondary fuel line of reduced cross section and at least one line branching off therefrom and terminating in said air line, as in a bypass air-type fuel metering system.

4. A fuel metering system as defined in claim 3, wherein the flow in said line branching off from said secondary fuel line is also controlled by said magnetic valve in dependence on the output signal of said measuring probe with said fuel line always maintaining a residual finite flow cross section.

5. A fuel metering system as defined in claim 4, wherein said membrane is mounted so as to close said air line when said magnetic valve is not energized.

6. A fuel metering system as defined in claim 4, wherein said magnetic valve controlling said air line and said secondary fuel line, operates such that the cross sections defined by said air and fuel lines and said valve are changeable in a reverse sense.

7. A fuel metering system as defined in claim 6, wherein said magnetic valve includes a movable member, the stroke of which along with the opening cross sections of said lines are proportional to the strength of the current applied to said magnetic valve, said current corresponding to a proportional control characteristic.

8. A fuel metering system as defined in claim 1, further comprising a nozzle which provides a residual open passage between said suction tube and said fuel line.

9. A fuel metering system as defined in claim 1, wherein the pressure of the air in said air line is greater than the ambient pressure.

10. A fuel metering system as defined in claim 1, wherein said magnetic valve is cycled in dependence on each pulse signal emanating from said measuring probe.

11. A fuel metering system as defined in claim 1, wherein the flow in said fuel line is also controlled by said magnetic valve in dependence on the output signal of said measuring probe with said fuel line, always maintaining a residual finite flow cross section.

12. A fuel metering system as defined in claim 11, wherein said magnetic valve controlling said air line and said fuel line, operates such that the cross sections defined by said air and fuel lines and said valve are changeable in a reverse sense.

13. A fuel metering system as defined in claim 12, wherein said magnetic valve includes a movable member, the stroke of which along with the opening cross sections of said lines are proportional to the strength of the current applied to said magnetic valve, said current corresponding to a proportional control characteristic.

* * * * *